United States Patent [19]

Ricketts

[11] 4,347,789

[45] Sep. 7, 1982

[54] DOWNHOLE DELAY ASSEMBLY FOR BLASTING WITH SERIES DELAY

[75] Inventor: Thomas E. Ricketts, Grand Junction, Colo.

[73] Assignee: Occidental Oil Shale, Inc., Grand Junction, Colo.

[21] Appl. No.: 169,025

[22] Filed: Jul. 15, 1980

[51] Int. Cl.[3] ..... C06C 5/04

[52] U.S. Cl. ..... 102/275.3; 102/275.7; 102/275.11; 102/275.12

[58] Field of Search ..... 102/275.3, 275.7, 217, 102/275.9, 275.11, 202.13, 275.12; 229/2, 13

[56] References Cited

U.S. PATENT DOCUMENTS

| | | | |
|---|---|---|---|
| Re. 30,621 | 5/1981 | Calder, Jr. et al. | 102/275.7 X |
| 3,618,519 | 11/1971 | Griffith | 102/217 X |
| 3,987,732 | 10/1976 | Spraggs et al. | 102/275.7 X |
| 3,987,733 | 10/1976 | Spraggs et al. | 102/275.3 X |
| 4,144,814 | 3/1979 | Day et al. | 102/202.13 |
| 4,166,418 | 9/1979 | Calder, Jr. | 102/275.3 X |
| 4,167,139 | 9/1979 | Gleason et al. | 102/275.3 X |
| 4,210,366 | 7/1980 | Hutchins et al. | 299/13 X |
| 4,238,136 | 12/1980 | Ricketts | 299/13 X |
| 4,239,285 | 12/1980 | French | 102/313 X |
| 4,281,878 | 8/1981 | Ricketts | 299/13 X |

*Primary Examiner*—Peter A. Nelson

*Attorney, Agent, or Firm*—Christie, Parker & Hale

[57] ABSTRACT

A downhole delay assembly is provided which can be placed into a blasthole for initiation of explosive in the blasthole. The downhole delay assembly includes at least two detonating time delay devices in series in order to effect a time delay of longer than about 200 milliseconds in a round of explosions. The downhole delay assembly provides a protective housing to prevent detonation of explosive in the blasthole in response to the detonation of the first detonating time delay device. There is further provided a connection between the first and second time delay devices. The connection is responsive to the detonation of the first detonating time delay device and initiates the second detonating time delay device.

A plurality of such downhole delay assemblies are placed downhole in unfragmented formation and are initiated simultaneously for providing a round of explosive expansions. The explosive expansions can be used to form an in situ oil shale retort containing a fragmented permeable mass of formation particles.

39 Claims, 4 Drawing Figures

DOWNHOLE DELAY ASSEMBLY FOR BLASTING WITH SERIES DELAY

The Government of the United States of America has rights in this invention pursuant to Cooperative Agreement DE-FC20-78LC10036 awarded by the U.S. Department of Energy.

BACKGROUND OF THE INVENTION

The presence of large deposits of oil shale in the Rocky Mountain region of the United States has given rise to extensive efforts to develop methods of recovering shale oil from kerogen in the oil shale deposits. The term "oil shale" as used in the industry is, in fact, a misnomer; it is neither shale nor does it contain oil. It is a formation comprising marlstone deposit containing an organic material called "kerogen" which, upon heating, decomposes to produce liquid and gaseous products. It is the formation containing kerogen that is called "oil shale" herein and the carbonaceous liquid product is called "shale oil".

The recovery of liquid and gaseous products from oil shale deposits has been described in several patents, one of which is U.S. Pat. No. 3,661,423, issued May 9, 1972, to Donald E. Garrett, assigned to the assignee of this application, and incorporated herein by this reference. This patent describes the formation of a fragmented permeable mass of oil shale particles in a subterranean formation containing oil shale by undercutting a portion of the subterranean formation, leaving unfragmented formation supported by a plurality of pillars. The pillars are removed, e.g., with explosive, and the unfragmented deposit is expanded to provide a permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen-supplying combustion zone feed into the retort on the trailing side of the combustion zone to advance the combustion zone through the fragmented mass. In the combustion zone, oxygen in the gaseous feed mixture is depleted by reaction with hot carbonaceous materials to produce heat and combustion gas. By the continued introduction of the oxygen-supplying feed into the combustion zone, the combustion zone is advanced through the fragmented mass. The effluent gas from the combustion zone passes through the retort on the advancing side of the combustion zone to heat the oil shale in a retorting zone to a temperature sufficient to produce kerogen decomposition called "retorting". Such decomposition in the oil shale produces gaseous and liquid products, including gaseous and liquid hydrocarbon products and a residual carbonaceous material. The resulting liquid and gaseous products pass to the bottom of the retort for collection.

It is desirable that the retort contain a reasonably uniform fragmented permeable mass of formation particles having a reasonably uniformly distributed void fraction so gases can flow uniformly through the retort, resulting in maximum conversion of kerogen to shale oil. A uniformly distributed void fraction in the direction perpendicular to the direction of advancement of the combustion zone is important to avoid channeling of gas flow in the retort. In preparation for the described retorting process, it is important that the formation be fragmented and displaced, rather than simply fractured, in order to create high permeability; otherwise, too much pressure differential is required to pass gas through the retort.

It has been proposed that oil shale be prepared for in situ recovery by first undercutting a portion of the formation to remove from about 5% to about 25% of the total volume of the in situ retort being formed, leaving the unfragmented portion supported by pillars. The pillars are then explosively expanded and, after a time delay, the unfragmented formation is expanded by detonating explosive placed in the pillars and in the unfragmented formation. This explosive expansion of pillars and unfragmented formation fills the void created by the undercut with a fragmented permeable mass of particles.

The general art of blasting rock formations is discussed in *The Blasters' Handbook,* 15th Edition, published by E. I. duPont de Nemours & Company, Wilmington, Delaware.

Other methods for preparing formation for in situ recovery are described in U.S. Pat. Nos. 4,043,597 and 4,043,598, both assigned to the assignee of this invention and both incorporated herein by this reference. According to these patents, at least two voids vertically spaced apart from each other are excavated in the subterranean formation. This leaves a zone of unfragmented formation between adjacent voids. Explosive is placed in blasting holes and detonated to expand formation in the intervening zone toward both voids.

U.S. Pat. No. 4,146,272 describes a method for forming an in situ oil shale retort by expanding formation toward vertically spaced apart voids containing support pillars. The pillars are explosively expanded to spread the particles thereof uniformly across the void, and unfragmented formation adjacent the void is explosively expanded toward the void before overlying, unsupported formation can cave into the void. U.S. Pat. No. 4,146,272 is incorporated herein by this reference.

To insure uniform void fraction distribution, pillars are explosively expanded first and then, after a time delay, the remaining unfragmented formation is explosively expanded, either in a single explosion or in a further series of explosions in a single round. One problem caused by use of a time delay method of blasting is that ground movement and/or airborne rock fragments ejected from a previous explosion can sever explosive initiating means. The initiating means, for example, can be trunk lines containing tie-up systems of detonating cord and time delay devices. Severing a trunk line can result in cutoff of a blasthole or blastholes serviced by the severed trunk line where the explosive in the blasthole is not initiated due to the severance. The lack of initiation of explosive in the blastholes causes formation in the area to remain unfragmented, resulting in an uneven distribution of void fraction of fragmented permeable mass in the in situ retort. In order to substantially decrease the probability of having a cutoff blasthole, it is, therefore, desirable to initiate all of the explosive trains downhole prior to the first explosions in a round of time delayed explosions. Explosive trains include initiating devices such as detonating cord, time delays, and primers.

In order to initiate the explosive trains in the blastholes prior to the first explosive expansion in a round of time delayed explosions, time delays must be available having both a required delay period and a required accuracy of timing. Time delays are presently commercially available with the desired delay period up to a delay period of about 200 milliseconds. Such time delays are generally available with delay periods of 25 milliseconds, 50 milliseconds, and continuing in 25 millisecond increments up to a delay of about 200 milliseconds. It is often required that time delays which are longer than about 200 milliseconds be provided for explosive expansion of unfragmented formation while forming an in situ oil shale retort. The presently available time delays which are longer than about 200 milliseconds do not provide a time delay in the required 25 millisecond increments and, in addition, may not have the required accuracy of delay. Both accuracy of timing and having the proper time interval between explosive expansions are significant while forming an in situ retort so that blastholes are detonated in the proper sequence. Explosive expansions having the proper time interval result in the creation of an in situ retort with a uniformly distributed fragmented permeable mass.

There is a need to provide a sufficiently accurate time delay of over 200 milliseconds in 25 millisecond intervals so as to enable total accurate time delays of 225 milliseconds, 250 milliseconds, 275 milliseconds, and so forth, up to a maximum required time delay in explosive expansions, for formation of in situ oil shale retorts.

The provision of sufficiently accurate time delays of over 200 milliseconds in 25 millisecond time increments allows initiation of all explosive trains downhole simultaneously, thereby substantially eliminating cutoff blastholes.

SUMMARY OF THE INVENTION

This invention relates to a downhole delay assembly provided for detonating explosive placed in a blasthole. The downhole delay assembly comprises a first detonating time delay device for introducing a first time delay in a detonation sequence. Means are provided for preventing detonation of explosive in the blasthole in response to detonation of the first detonating time delay device. A second detonating time delay device is provided for introducing a second time delay in the detonation sequence and for initiating explosive in the blasthole. Means are provided for connecting the first time delay device to the second time delay device. The connecting means provides for initiation of the second time delay device in response to the detonation of the first time delay device. Support means are provided for supporting the first and second time delay devices for placement in the blasthole.

DRAWINGS

These and other features, aspects, and advantages of the present invention will become more apparent when considered with respect to the following description, appended claims, and accompanying drawings wherein:

DETAILED DESCRIPTION

Figure 1:
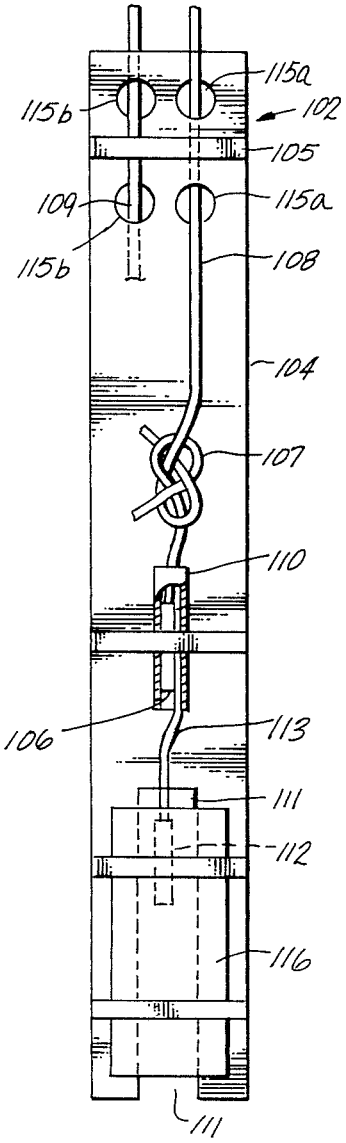
FIG. 1 is an illustration of a downhole delay assembly.

Referring to FIG. 1, a downhole delay assembly 102 useful in practice of principles of this invention is illustrated. The downhole delay assembly 102 can include a support 104 and at least one time delay circuit mounted on the support. Such a time delay circuit includes a first detonating time delay device 106 on the support, which can be contained in a protective housing 110. An initiating device such as a detonating cord 108 is connected to the first time delay device. A second detonating time delay device 112 is embedded in a primer 116 and is connected to the first detonating time delay device by a detonating cord lead, i.e., a fuse 113.

In a working embodiment, the support 104 is a wooden board about 27 inches long and about 4 inches wide, cut from a ½-inch thick plywood. A 10-inch long slot 111, 1-½ inches wide, is provided at the bottom end of the board. Four 1-inch diameter holes 115 are drilled through the board near the upper end of the board. If desired, the support can also be fabricated from other non-sparking materials such as plastic and the like.

The initiating device 108 of the working embodiment is a reinforced detonating cord which has one end passed through two of the vertically spaced apart holes 115*a* which have been drilled through the board. The reinforced detonating cord passing through the holes, frictionally engages the board and thus is mechanically connected to the board. The detonating cord can support the board as it is lowered into the blasthole. The reinforced detonating cord is securely attached with tape 105 to the board between the sets of holes near the upper end of such board. The tape helps keep the detonating cord from slipping out of the holes. Various adhesive tapes can be used such as electrical tape and the like.

In the working embodiment, the first detonating time delay device 106 is a non-electric time delay blasting cap. The detonating cord 108 is knotted to the lead 107, i.e., the fuse, of the first non-electric time delay blasting cap and thus the detonating cord is connected operationally to the first non-electric time delay blasting cap.

Non-electric time delay blasting caps useful in practice of principles of this invention are designed to convert the burning of the detonating cord into a detonation. A typical blasting cap consists of an aluminum shell loaded with an explosive charge. The aluminum shell contains a base charge of high velocity explosive in the bottom, then in sequence vertically, a primer charge, a charge of delay powder, and a charge of ignition powder on top. The ignition powder insures flame pickup from the detonating cord, the delay powder produces a time delay by burning for a set time period before igniting the primer charge, and the primer charge transforms the burning into detonation and initiates the high explosive base charge which bursts the aluminum shell. Various time delays are obtained with differing delay powder trains.

If desired, in practice of this invention, the first detonating time delay device can be an electric time delay blasting cap. If the first detonating time delay device is an electric time delay blasting cap, the initiating means is a set of connecting wires for conduction of electrical current. The wires are connected to the electric time delay blasting cap on one end and to a power source on the other end. The power source supplies current for initiating the electric time delay blasting cap.

The first time delay blasting cap 106 is connected to the second detonating time delay device 112. In the working embodiment, the first time delay blasting cap is taped directly to the lead or fuse 113 of the second detonating time delay device. The second detonating time delay device of this embodiment is a non-electric time delay blasting cap 112. Both the first time delay blasting cap 106 and the lead 113 of the second non-electric time delay blasting cap 112 are contained in the protective housing 110. The protective housing is a ½-inch internal diameter section of polyvinylchloride (PVC) tubing about 6 inches long with a ¼-inch wall section. The protective housing is taped securely to the wooden board.

If desired, the protective housing can be made of other non-sparking materials such as copper, CRES steel, and the like.

The protective housing is provided to insure that the connection between the first time delay blasting cap 106 and the lead 113 of the second time delay blasting cap 112 remains intact. The protective housing also contains energy from detonation of the first time delay blasting cap to prevent premature detonation of explosive in the blasthole where a cap sensitive explosive is used.

At least three pounds of primer are provided for initiating the explosive in the blasthole. The primer is a cap sensitive explosive such as a cartridge of pentaerythritol tetranitrate (PETN) or the like. The primer can be provided as a cast primer, which is cylindrical or in other shapes, if desired.

In the working embodiment, a three pound cast primer 116 is taped to the board 104 near the bottom end of the board. The primer is positioned by a side engaging the slot 111 and is taped securely to the board.

The second non-electric time delay blasting cap 112 is inserted deeply into the center of the cylindrical cast primer 116 and is aligned so that the blasting cap lies parallel to the long axis of the primer.

If desired, downhole delay assemblies can be provided that require no primer. For example, no primer is required for initiation of explosive when cap sensitive explosive is used in the blasthole. In the event that no primer is provided, the cap sensitive explosive in the blastholes will be initiated by the detonation of the second detonating time delay device, i.e., the non-electric time delay blasting cap 112.

The first non-electric time delay blasting cap 106, second non-electric time delay blasting cap 112, the protective housing 110, and the means 113 connecting the first and second non-electric time delay blasting caps comprise a time delay circuit. In order to provide for reliability of operation of the downhole delay device, a second time delay circuit substantially identical to the first time delay circuit can also be provided. The second time delay circuit is generally placed on the opposite side of the support from the first time delay circuit.

Where a second time delay circuit is used, a second reinforced detonating cord 109 is extended through the second pair of holes **115*b*** vertically spaced apart near the upper end of the support. The components of the second redundant time delay circuit (not shown) are connected together and attached to the board, similar to the manner in which the first time delay circuit is connected together and attached to the board as described hereinabove. The redundant time delay circuit is placed on the opposite side of the board to assure that there is no interference between the two time delay circuits.

Where a redundant time delay circuit is used, the total amount of primer required for initiation of explosive in the blasthole remains at about three pounds. The cast primer or primers used can be mounted on the support in various configurations. For example, where a three pound cast primer is provided, such as the primer 116, the second non-electric time delay blasting cap of the second time delay circuit can be embedded in the opposite end of the primer from the second time delay blasting cap of the first time delay circuit. Alternatively, two 1 pound cast primers can be taped securely to one side of the board and an additional 1 pound cast primer can be taped to the opposite side of the board. Each primer is placed so as to engage the slot in the board so that each primer contacts one or both of the other primers. The second non-electric time delay blasting cap of the first time delay circuit is inserted into a primer which is on the side of the board with the first time delay circuit. The second non-electric time delay blasting cap of the second, redundant time delay circuit is inserted into a primer which is on the side of the board with the second time delay circuit.

If desired, the primers can be placed on the support in other arrangements, e.g., for redundancy, two 3 pound cast primers can be placed end to end with the second time delay blasting cap of the first time delay circuit embedded in the top primer and the second time delay blasting cap of the second circuit embedded in the bottom primer. Other arrangements of primers can also be used.

Having a downhole delay assembly that comprises two time delay circuits improves the reliability of the assembly for initiation of explosive in the blasthole. If triple redundancy is desired, a third detonating cord can be provided through a third pair of holes drilled through the board near the upper end of the board. The third detonating cord is taped to the board on the face of the board spaced apart from either the first or second time delay circuits. The components of the third time delay circuit are substantially identical to the components of the first and second time delay circuits and are attached to one another and to the support in a similar manner as the components of the first and second time delay circuits are attached.

Figure 2:
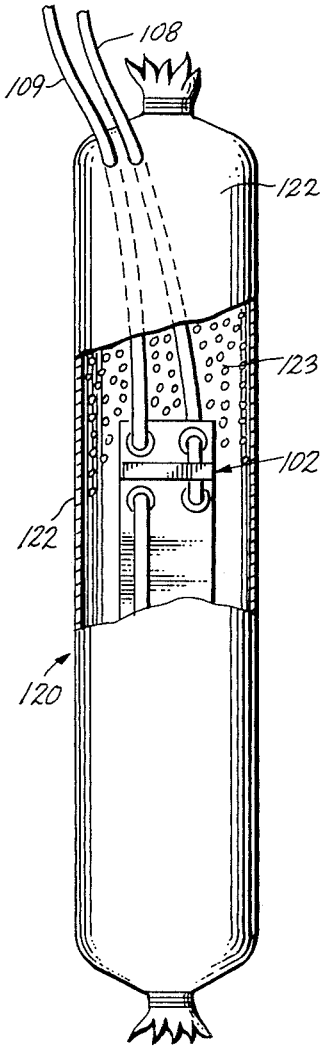
FIG. 2 is an illustration partly in cross-section showing a downhole delay assembly contained in a downhole delay package.

The downhole delay assembly can be placed into a delay explosive package 120 or the like, as illustrated in FIG. 2, prior to loading the downhole delay assembly into a blasthole. The delay explosive package 120 includes an outer container 122 which, in the working embodiment, is a 6 mil thick plastic tube tied at both ends. The delay explosive package contains a slurry explosive 123 such as an aluminized TNT slurry.

The delay explosive package 120 protects the downhole delay assembly 102 as the downhole delay assembly is lowered into the blasthole and insures that the downhole delay assembly will be in intimate contact with explosive.

In addition, the body of explosive in the delay explosive package can absorb energy of detonation of the first detonating time delay device. The absorption of energy of the first detonating time delay device can prevent premature detonation of explosive in the blasthole when cap sensitive explosive is used in such a blasthole.

When the downhole delay package is provided to absorb energy of detonation of the first detonating time delay device, the explosive used in the downhole delay package is a cap insensitive explosive. Cap insensitive explosive includes explosives such as ammonium nitrate mixed with fuel oil (ANFO). Detonation of a cap insensitive explosive can be initiated by an explosive primer such as the cylindrical explosive primer 116.

The outer container 122 has holes through which the detonating cords 108 and 109 extend. The detonating cords are attached as described hereinabove to the downhole delay assembly and can be used for lowering the downhole delay assembly into the blasthole. Preferably, however, a rope can be attached to the delay explosive package for lowering the delay explosive package and downhole delay assembly into the blasthole. The rope used can be securely fastened to the downhole delay assembly by tying the rope to the assembly. It is preferred, however, that the rope be tied or otherwise securely fastened to the outer container of the delay explosive package for lowering the explosive package and downhole delay assembly into the blasthole.

The ends of the detonating cords 108 and 109 not connected to the downhole delay assembly are tied into a trunk line or the like which provides the source of ignition for the detonating cord for initiation of the time delay circuit(s).

If desired, the downhole delay assembly can be provided without a support. For example, the downhole delay assembly can consist of one or more time delay circuits wherein such time delay circuits are embedded in a container or explosive. The container of explosive and delay circuit(s) comprising the downhole delay assembly can then be lowered into a blasthole for providing the time delay and means for detonating the explosive in the blasthole. As discussed hereinabove, the explosive in the container can be provided as a cap insensitive explosive which can absorb energy of detonation of the first time delay blasting cap in each time delay circuit.

The operation of the downhole delay assembly is initiated by the burning or detonation of the detonating cord, such as the reinforced detonating cord 108. Detonating cord has a high velocity of detonation, exploding at about 21,000 feet (nearly four miles) per second. The detonation travels down the detonating cord as a first input signal to the first non-electric time delay blasting cap. The first input signal initiates the first non-electric time delay blasting cap. After a time delay produced by the first time delay blasting cap, the first blasting cap detonates. Essentially the same events occur when the first blasting cap is electrically initiated. The detonation of the first time delay blasting cap is a first output signal. Such a first output signal initiates the lead of the second non-electric time delay blasting cap, thereby initiating the second non-electric time delay blasting cap. The first time delay blasting cap 106 is housed in the protective housing 110. As described above, one function of the protective housing is to contain energy of the first output signal created by the detonation of the first time delay blasting cap. The containment by the protective housing of the energy of detonation of the first time delay blasting cap precludes such detonation from prematurely detonating the primer or the explosive contained in the blasthole.

In an exemplary embodiment, the time delay of the first non-electric time delay blasting cap is 200 milliseconds. In practice of this invention, however, if desired, the time delay of the first non-electric time delay blasting cap can be more or less than about 200 milliseconds. After a second time delay introduced by the second non-electric time delay blasting cap, the second non-electric time delay blasting cap detonates. The second time delay can be from about 25 to about 200 milliseconds, depending on the time delay selected. The detonation of the second non-electric time delay blasting cap is the second output signal and initiates the primer 116. The primer explodes, thereby initiating detonation of explosive in the blasthole.

The total time delay produced by the downhole delay assembly is the sum of the time-delays of the first and second time delay blasting caps in series. Thus, time delays of from about 50 to about 400 milliseconds can be achieved using the two time delay blasting caps in series. Preferably, however, the total time delay is from about 225 to about 400 milliseconds.

If desired, longer time delays can be achieved by adding a third time delay in series with the first two time delays, such time delays being added in series until the required time delay is achieved. When three time delays are used, for example, both the first and second detonating time delay devices are provided in a protective housing, as was the first detonating time delay device 106 of the working embodiment. The third time delay device, which is the last time delay device in the series, is embedded in a primer for initiating detonation of the explosive in the blasthole.

Where redundancy is desired, a downhole delay assembly is provided which comprises two time delay circuits as described hereinabove. Both detonating cords 108 and 109 are tied on one end (not shown) into a trunk line which provides a source of ignition. Both detonating cords 108 and 109 are ignited simultaneously and burn to initiate their respective time delay circuits. The time delay circuits are constructed so that the time delay of the first conduit is about equal to the time delay of the second circuit. The operation of the second time delay circuit is substantially identical to the operation as described hereinabove for the first time delay circuit.

The downhole delay assembly 102 as described hereinabove can be used to advantage when an in situ oil shale retort is being formed using a round of explosions wherein at least one of the explosions is in a time delay longer than about 200 milliseconds.

For example, when oil shale is explosively expanded towards a horizontal void or voids and the void contains a pillar, it is desirable to explosively expand the pillar a substantial time interval before explosively expanding oil shale towards the horizontal free faces of the void.

Thus, for purposes of exposition herein, a pillar can be explosively expanded with charges having time delays of 25 milliseconds for a first explosive expansion and 125 milliseconds for a second explosive expansion. In addition, there can be a time delay of about 100 milliseconds between the final explosive expansion of the pillar and the explosive expansion of oil shale to allow for formation of a free face at the junction of the pillar and the unfragmented formation. Since the pillars are explosively expanded prior to explosive expansion of the formation above or below the void, a blast design often requires explosive expansion of formation towards horizontal free faces with time delays well in excess of 200 milliseconds. With such a blast design, detonating cord, detonators, and time delay devices must be provided within the blastholes for protection to insure that there are no cutoff blastholes. Further, each of the explosive trains must be initiated downhole prior to the first explosive expansion of the pillars.

Previously, delays had been provided in trunk lines to a number of blastholes with delays also provided downhole for additional sequencing of detonation. Such trunk lines would normally lie exposed on the floor, i.e., on the horizontal free face of the formation to be explosively expanded. Reliance on delays in trunk lines to the blastholes is not feasible since such trunk lines can be destroyed by ground movement and/or fragments from the pillars.

Such assemblies having additive time delays should be prepared in advance of the blasthole loading so that loading the explosives in blastholes for blasting can be performed expediously. Double or triple redundancy, as described above, is also desirable to assure that detonation occurs in each blasthole. The downhole delay assembly as described hereinabove has therefore been developed to provide for time delays of over 200 milliseconds.

Figure 3:
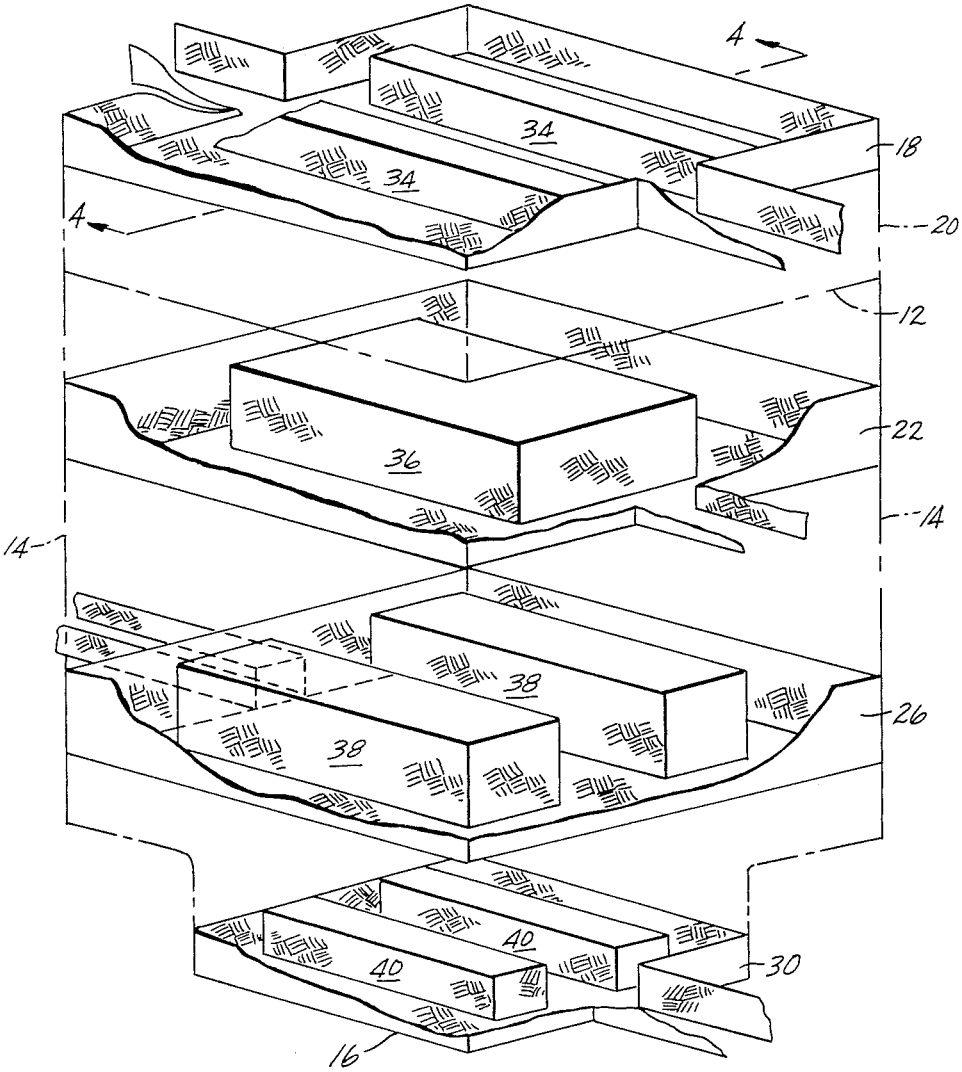
FIG. 3 is a fragmentary semi-schematic perspective view showing a subterranean formation containing oil shale prepared for explosive expansion for forming an in situ retort indicating an embodiment of usage of the downhole delay assembly.
Figure 4:
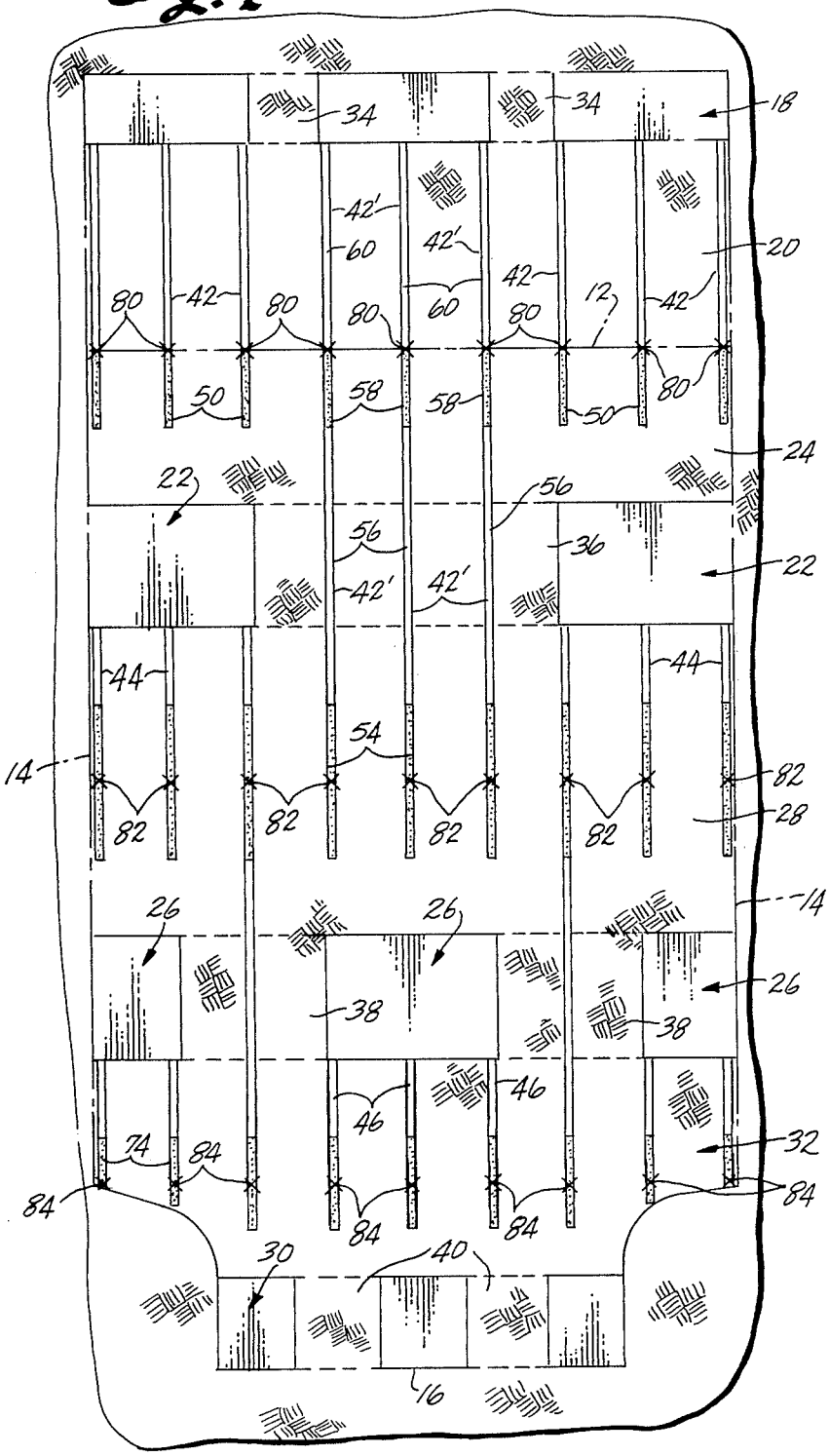
FIG. 4 is a fragmentary, semi-schematic, vertical cross-sectional view taken on line 4—4 of FIG. 3.

FIGS. 3 and 4 schematically illustrate an in situ oil shale retort being formed which employs principles of this invention; that is, using time delays of longer than about 200 milliseconds. Such time delays can be achieved by the use of the downhole delay assembly of this invention.

The in situ retort is formed in a subterranean formation containing oil shale. The in situ retort shown in FIGS. 3 and 4 is square or rectangular in horizontal cross-section, having a top boundary 12, four vertically extending side boundaries 14, and a bottom boundary 16.

The in situ retort is formed by a horizontal free face system in which formation is excavated from within the retort site for forming a plurality of vertically spaced apart voids, each extending horizontally across a different level of the retort site, leaving one or more zones of unfragmented formation within the retort site between adjacent pairs of horizontal voids. The formation of an in situ retort by a horizontal free face system is described in U.S. Pat. No. 4,192,554, which is incorporated herein by this reference.

For clarity of illustration, each horizontal void is illustrated in FIG. 3 as a rectangular box having an open top and a hollow interior. One or more pillars of unfragmented formation remain within each void for providing temporary roof support. The pillars are illustrated as rectangular boxes inside the voids illustrated in FIG. 3.

In the embodiment illustrated in FIGS. 3 and 4, a portion of the formation within the retort site is excavated on an upper working level for forming an open base of operations 18. The floor of the base of operations is spaced above the top boundary 12 of the retort being formed, leaving a horizontal sill pillar 20 of unfragmented formation between the floor of the base of operations and the top boundary 12 of the retort being formed. The horizontal cross-sectional area of the base of operations is sufficient to provide effective access to substantially the entire horizontal cross-section of the retort being formed.

In the horizontal free face system illustrated in FIGS. 3 and 4, three vertically spaced apart horizontal voids are excavated within the retort site. A rectangular upper void 22 is excavated at a level spaced vertically below the base of operations 18, leaving an upper zone 24 of unfragmented formation extending horizontally across the retort site between the upper void 22 of the retort being formed and the bottom of the sill pillar 20. A rectangular intermediate void 26 is excavated at an intermediate level of the retort being formed, leaving an intermediate zone 28 of unfragmented formation extending horizontally across the upper void and a horizontal upper free face above the intermediate void. A production level void 30 is excavated at a lower production level of the retort being formed, leaving a lower zone 32 of unfragmented formation extending horizontally across the retort site between a horizontal lower free face below the intermediate void and a horizontal upper free face above the production level void.

One or more pillars are left within each of the horizontal voids for providing temporary roof support for the zone of unfragmented formation overlying each void. Each support pillar comprises a column of unfragmented formation integral with and extending between the roof and the floor of each horizontal void.

As illustrated in FIG. 3, the upper void 22 includes one large support pillar 36 of rectangular horizontal cross-section located centrally within the upper void. The intermediate void 26 includes a pair of laterally spaced apart, parallel, relatively long and narrow support pillars 38. The production level void 30 includes a pair of laterally spaced apart, relatively long and narrow, parallel support pillars 40 extending a major part of the width of the production level void.

Referring to the embodiment illustrated in FIG. 4, a plurality of mutually spaced apart vertical upper blastholes 42 are drilled down from the base of operations through the sill pillar 20 and into at least an upper portion of the upper zone 24 of unfragmented formation above the upper void 22. Further, a plurality of mutually spaced apart vertical intermediate blastholes 44 are drilled down from the floor of the upper void 22 into at least a portion of the intermediate zone 28 of unfragmented formation below the upper void 22 and a plurality of mutually spaced apart vertical lower blastholes 46 are drilled down from the floor of the intermediate void into a portion of the lower zone 32 of unfragmented formation below the intermediate void.

Blasting toward each horizontal void is provided by explosively expanding a zone of formation upwardly and/or downwardly toward each void across the entire width of such a void.

Placement of explosive charges, downhole delay assemblies, and stemming into the blastholes is best understood with reference to FIG. 4. The downhole delay assemblies placed into the blastholes are designated by an "x". To more clearly illustrate the placement of materials into the blastholes, the blastholes are shown out of proportion in FIG. 4, i.e., the diameter of the blastholes is actually much smaller in relation to the horizontal dimensions of the retort than is shown in FIG. 4. In an exemplary embodiment, the entire upper zone 24 of unfragmented formation is explosively expanded downwardly toward the upper void 22, and approximately the upper half of the intermediate zone 28 of formation below the floor of the upper void is simultaneously expanded upwardly toward the upper void. Similarly, approximately the lower half of the intermediate zone of unfragmented formation above the intermediate void 26 is explosively expanded downwardly toward the intermediate void while the upper portion of the lower zone of unfragmented formation is simultaneously explosively expanded upwardly toward the intermediate void. The lower portion of the lower zone of unfragmented formation is explosively expanded downwardly toward the lower production level void 30.

The short upper blastholes 42 are loaded with explosive 50 up to the top boundary 12 of the upper zone of unfragmented formation, i.e., to the bottom of the sill pillar 20. A downhole delay assembly having a required time delay and contained in a delay explosive package is lowered into each blasthole 42 by using the attached reinforced detonating cord or a rope or the like, and the blasthole is stemmed with an inert material such as gravel. The downhole delay assembly can be lowered directly into the explosive in the blasthole or can be imbedded a short distance into the top portion of the column of explosive. For example, the downhole delay assembly can be placed a foot or so from the top end of the column of explosive and the remaining explosive placed above the delay assembly. This placement of the downhole delay assembly can be accomplished to assure that it is buried in the explosive for reliable detonation. Similarly, downhole delay assemblies located at the mid-point of a column of explosive, as in the intermediate zone 28, can be located somewhat off center due to errors in measurement or placement. Such deviations are routine and have minimal effect on the resulting explosive expansion. Even with such deviation from precise location of the downhole delay assemblies, the direction of propagation of detonation in the explosive is substantially towards the respective free faces.

The long upper blastholes 42' are drilled about three-fourths of the way through the intermediate zone 28 of unfragmented formation and a bottom portion of these blastholes is loaded with explosive 54. A downhole delay assembly is placed at about the center of each column of explosive 54. The intermediate portion 56 of each of the blastholes is stemmed and a separate upper column 58 of explosive is loaded above the stemming in each of the intermediate portions of these blastholes. A downhole delay assembly is lowered into each of the blastholes 42' onto the top of the column of explosive 58. As discussed hereinabove, the downhole delay assembly can be located a foot or so below the top of the explosive column 58 in the blasthole. The upper columns 58 of explosive extend through the upper half of the upper zone of unfragmented formation, i.e., for approximately the same depth as the explosive columns 50 in the short upper blastholes 42. The remaining upper portions 60 of the long upper blastholes 42', i.e., the portions which extend through the sill pillar, are stemmed.

The downhole delay assemblies (represented by an "x" at 80 in FIG. 4) are placed above the columns of explosive 50 and 58 in the blastholes in the upper zone of unfragmented formation as described above. Thus, each of these downhole delay assemblies is at the same elevation in the retort, namely at the top boundary 12 of the upper zone of unfragmented formation. Detonation of explosive in the upper blastholes is initiated such that the direction of propagation of detonation is toward the upper free face adjacent the upper void.

In the intermediate zone of unfragmented formation, a downhole delay assembly (represented by an "x" at 82 in FIG. 4) is placed in the center of each column of explosive for initiating detonation of such explosive upwardly toward the upper void and downwardly toward the lower void. These downward delay assemblies are positioned at a level approximately mid-way between the lower free face of formation adjacent the upper void and the upper free face of formation adjacent the lower void. Detonation is initiated in the middle of the intermediate zone so that detonation propagates toward each of two adjacent free faces and such initiation results in a better cratering effect than initiation at other points within the intermediate zone would produce.

Separate downhole delay assemblies (represented by an "x" at 84 in FIG. 4) are placed at about the same level in each of the columns of explosive in the lower zone of unfragmented formation, namely about between the intermediate void and the production level void. Detonation of explosive in the lower blastholes is initiated such that the direction of propagation of detonation is upwardly toward the lower free face adjacent the intermediate void.

Explosive is also placed in the support pillars in the upper, intermediate, and lower voids. Horizontally extending blastholes can be drilled in the pillars and such blastholes loaded with explosive and a detonator. The detonator used in the pillar blastholes can be a downhole delay assembly if the time delay required for that particular explosive expansion is greater than about 200 milliseconds. A variety of arrangements of horizontal blastholes can be used depending on the size and shape of the pillars. Alternatively, the vertical blastholes drilled through the pillars can be loaded with explosive charges. Sufficient explosive is placed in the pillars to explosively expand the entire unfragmented mass of each pillar toward its respective void.

The in situ retort can be created using a carefully coordinated sequence of blasting events beginning with the destruction of the pillars. All explosive trains in the blastholes of the upper, intermediate, and lower zones of unfragmented formation and the explosive trains in the blastholes of the pillars are initiated simultaneously. The explosive trains are initiated downhole before pillars are explosively expanded to insure that there are no detonating cord or electrical line cutoffs caused by the explosive expansion of the pillars.

Accurate time delays of greater than 200 milliseconds with 25 millisecond time intervals can be required to insure uniform distribution of pillar fragments, to produce a retort with a desired void at the top, to avoid excess seismic shock, to produce a retort with an evenly distributed fragmented mass, and the like.

As described hereinabove, there are many different specific time delays required in explosive expansion of unfragmented formation for forming an in situ oil shale retort. These time delays which are longer than about 200 milliseconds can be achieved by the use of the downhole delay assembly as described hereinabove.

In practice of principles of this invention, therefore, the time delay required for each blasthole in the blasting event is calculated, and for those blastholes which require a time delay of longer than about 200 milliseconds, a downhole delay assembly is constructed using the required time delay devices connected in series as discussed hereinabove. In order to evaluate the length of the time delay required for each blasthole, many factors are evaluated, including the size of the pillars, the pattern of the mined out portions of the subterranean formation, the desired void fraction of the retort, the desired space between the top of fragmented permeable mass and unfragmented formation in the retort, and other like factors.

Once the downhole delay explosive packages containing the downhole delay assembly, explosive, and stemming are in place, the round of explosions is started by simultaneously initiating the explosive trains downhole in all of the blastholes, including explosive trains in the pillars.

The simultaneous initiation of explosive trains in the blastholes of both the pillars and unfragmented formation eliminates the problem of cutoff blastholes caused by ground movement and/or pillar ejecta severing trunk lines lying on the free faces of the void space.

In the illustrated embodiment, the first explosive expansion of unfragmented formation other than the pillars has a time delay of about 225 milliseconds and the last explosive expansion of unfragmented formation has a time delay of about 400 milliseconds. The result of using a downhole delay assembly having time delays of greater than 200 milliseconds to effect the time delays between 225 and 400 milliseconds is the formation of an in situ retort with a substantially uniform fragmented permeable mass.

Following explosive expansion of the formation to form a fragmented mass of oil shale in the retort, at least one gas access communicating with an upper level of the fragmented mass is established by forming a plurality of communicating vertical conduits to the top of the fragmented permeable mass of expanded formation contained in the retort.

Thereafter, the recovery of shale oil and gaseous products from the oil shale in the retort involves the movement of a retorting zone through the fragmented permeable mass of formation particles in the retort. The retorting zone can be established on the advancing side of a combustion zone in the retort or it can be established by passing heated gas through the retort. It is generally preferred to advance the retorting zone from the top to the bottom of a vertically oriented retort; that is, a retort having a vertical side boundary. With this orientation, the shale oil and gaseous products are produced in the retorting zone and move downwardly toward the base of the retort for collection and recovery, aided both by the force of gravity and by gases introduced at the upper elevation.

The above description of a downhole delay assembly and the use of such downhole delay assembly for forming an in situ oil shale retort in a subterranean formation is for illustrative purposes. Because of variations which will be apparent to those skilled in the art, the present invention is not intended to be limited to the particular embodiments described above. The scope of the invention is defined in the following claims.

I claim:

1. A downhole delay assembly for detonating explosive placed in a blasthole, the assembly comprising:

a first detonating time delay device for introducing a first time delay in a detonation sequence;

means for preventing detonation of explosive in a blasthole in response to detonation of the first detonating time delay device;

a second detonating time delay device for introducing a second time delay in the detonation sequence and for initiating explosive in the blasthole;

means for connecting the first time delay device to the second time delay device for initiating the second time delay device in response to the detonation of the first time delay device; and support means for supporting the first and second time delay devices for placement in a blasthole.

2. The downhole delay assembly as claimed in claim 1 wherein the first detonating time delay device is a non-electric time delay blasting cap.

3. The downhole delay assembly as claimed in claim 1 wherein the total of the first and second time delays is more than about 200 milliseconds.

4. The downhole delay assembly as claimed in claim 1 wherein the means for preventing detonation of explosive in the blasthole in response to detonation of the first detonating time delay device is a protective housing for containing energy from the detonation of the first detonating time delay device.

5. The downhole delay assembly as claimed in claim 1 wherein the means for preventing detonation of explosive in the blasthole in response to detonation of the first detonating time delay device comprises a body of cap insensitive explosive having the first detonating time delay device embedded therein.

6. The downhole delay assembly as claimed in claim 1 wherein the second detonating time delay device is a non-electric time delay blasting cap.

7. The downhole delay assembly as claimed in claim 1 wherein the means for initiating the second detonating time delay device comprises a detonating cord lead which connects the first time delay device to the second time delay device.

8. The downhole delay assembly as claimed in claim 1 further comprising a primer on the support means for detonating an explosive in the blasthole wherein the second detonating time delay device is embedded in the primer for detonating the primer.

9. A downhole delay assembly for detonating an explosive placed in a blasthole, the downhole delay assembly comprising:

a first non-electric time delay blasting cap for introducing a first time delay in a detonation sequence;

means for preventing detonation of explosive in a blasthole in response to a detonation of the first non-electric time delay blasting cap;

a second non-electric time delay blasting cap for introducing a second time delay in the detonation sequence and for initiating an explosive in the blasthole;

means for connecting the second non-electric time delay blasting cap in series in the detonation sequence with the first non-electric time delay blasting cap for initiating the second non-electric time delay blasting cap in response to the detonation of the first non-electric time delay blasting cap; and support means for supporting the first and second non-electric time delay blasting caps for placement in a blasthole.

10. The downhole delay assembly as claimed in claim 9 wherein the means for preventing detonation of explosive in the blasthole in response to detonation of the first non-electric time delay blasting cap is a protective housing for containing energy from the detonation of such first non-electric time delay blasting cap.

11. The downhole delay assembly as claimed in claim 9 wherein the means for preventing detonation of explosive in the blasthole in response to detonation of the first non-electric time delay blasting cap comprises a body of cap insensitive explosive having the first detonating time delay blasting cap embedded therein.

12. The downhole delay assembly as claimed in claims 10 or 11 further comprising a primer on the support means for detonating an explosive in the blasthole wherein the second non-electric time delay blasting cap is embedded in the primer for detonating the primer.

13. The downhole delay assembly as claimed in claim 9 wherein the total of the first and second time delays is more than about 200 milliseconds.

14. A downhole delay assembly for detonating explosive in a blasthole, the downhole delay assembly comprising:

a first non-electric time delay blasting cap for introducing a first time delay in a detonation sequence;

a second non-electric time delay blasting cap for introducing a second time delay in the detonation sequence and for initiating a primer in the blasthole;

means for connecting the second non-electric time delay blasting cap in series in the detonation sequence with the first non-electric time delay blasting cap for initiating the second non-electric time delay blasting cap in response to the detonation of the first non-electric time delay blasting cap, the total time delay in the detonation sequence being more than about 200 milliseconds; and support means for supporting the first and second time delay devices for placement in a blasthole.

15. A downhole delay assembly for detonating an explosive in a blasthole, the downhole delay assembly comprising:

a first detonating time delay device for introducing a first time delay between an input signal into the first detonating time delay device and a first output signal from the first detonating time delay device;

means for preventing detonation of explosive in a blasthole in response to the first output signal;

a second detonating time delay device responsive to the first output signal for introducing a second time delay between the first output signal and a second output signal, the second output signal being provided by the second time delay device;

means for detonating explosive in response to the second output signal; and means for supporting the first and second time delay devices for placement in a blasthole.

16. The downhole delay assembly as claimed in claim 15 wherein the means for preventing detonation of explosive is a protective housing for containing energy of the first output signal.

17. The downhole delay assembly as claimed in claim 15 wherein the means for preventing detonation of explosive comprises a body of cap insensitive explosive having the first detonating time delay device embedded therein.

18. The downhole delay assembly as claimed in claim 15 wherein the first detonating time delay device is a non-electric time delay blasting cap and the first output signal is provided by detonation of the first time delay blasting cap.

19. The downhole delay assembly as claimed in claim 18 wherein the second detonating time delay device is a non-electric time delay blasting cap.

20. The downhole delay assembly as claimed in claim 15 wherein the total of the first and second time delays is more than about 200 milliseconds.

21. The downhole delay assembly as claimed in claim 20 wherein the means for detonating explosive in response to the second output signal is a primer having the second detonating time delay device embedded therein.

22. A downhole delay assembly for detonating an explosive in a blasthole, the downhole delay assembly comprising:

a first non-electric time delay blasting cap for introducing a first time delay between a first input signal into the first non-electric time delay blasting cap and a first output signal initiated by detonation of the first non-electric time delay blasting cap;

a detonating cord connected to the first non-electric time delay blasting cap for providing the first input signal into the first non-electric time delay blasting cap;

a body of cap insensitive explosive having the first non-electric time delay blasting cap embedded therein for preventing detonation of explosive in the blasthole in response to the first output signal;

a second non-electric time delay blasting cap responsive to the first output signal for introducing a second time delay between the first output signal and a second output signal provided by the second non-electric time delay blasting cap;

a primer for detonating explosive responsive to the second output signal; and means for supporting the first and second non-electric time delay blasting caps for placement in a blasthole.

23. An explosive device for detonating explosive in a blasthole comprising:

a time delay circuit embedded in a cap insensitive explosive comprising:

a first non-electric time delay blasting cap for introducing a first time delay;

a second non-electric time delay blasting cap for introducing a second time delay and for initiating explosive; and means connecting the first non-electric time delay blasting cap to the second non-electric time delay blasting cap for initiating the second non-electric time delay blasting cap in response to detonation of the first non-electric time delay blasting cap.

24. The explosive device as claimed in claim 23 wherein the explosive device additionally comprises a support on which the time delay circuit is mounted and wherein the first non-electric time delay blasting cap is connected to a detonating cord which is attached to said support for lowering the explosive device into a blasthole.

25. The explosive device as claimed in claim 23 wherein the total of the first and second time delays is more than about 200 milliseconds.

26. An explosive device for detonating an explosive in a blasthole comprising:

a time delay circuit embedded in a cap insensitive explosive comprising:

a first detonating time delay device for introducing a first time delay between an input signal into the first detonating time delay device and a first output signal from the first detonating time delay device;

a second detonating time delay device responsive to the first output signal for introducing a second time delay between the first output signal and a second output signal, wherein the second output signal is provided by the second detonating time delay device; and means for detonating explosive in response to the second output signal.

27. The explosive device as claimed in claim 26 additionally comprising a support on which the time delay circuit is mounted and wherein the first detonating time delay device is connected to a detonating cord which is attached to the support for lowering the explosive device into a blasthole.

28. The explosive device as claimed in claim 26 wherein the first detonating time delay device is a non-electric time delay blasting cap, and the first output signal is provided by detonation of said first non-electric time delay blasting cap, and wherein the second detonating time delay device is a non-electric time delay blasting cap and the means for detonating explosive in response to the second output signal is a primer in which the second detonating time delay device is embedded.

29. The explosive device as claimed in claim 28 wherein the total of the first and second time delays is more than about 200 milliseconds.

30. A method for detonating explosives in a plurality of blastholes, wherein said explosives are to be detonated in a series of explosions in a single round in which prior explosions in such round can cause ground movement and/or can produce airborne rock fragments which can sever trunk lines for initiating detonation of such explosive, the method comprising:

simultaneously initiating explosive trains in substantially all of the blastholes, wherein at least a portion of the blastholes have explosive trains which include downhole delay devices; and in each downhole delay device:

initiating a first detonating time delay device;

preventing detonation of explosive in the blasthole in response to detonation of the first detonating time delay device; and initiating a second detonating time delay device in response to detonation of the first detonating time delay device for detonating explosive in the blasthole.

31. The method according to claim 30 wherein the first and second time delay devices are non-electric time delay blasting caps.

32. The method according to claim 30 wherein the total time delay provided by the first and second time delay devices is more than about 200 milliseconds.

33. The method according to claim 30 wherein detonation of explosive in the blasthole in response to detonation of the first detonating time delay device is prevented by enclosing the first detonating time delay device in a housing for containing energy from detonation of the first detonating time delay device.

34. The method according to claim 30 wherein detonation of explosive in the blastholes in response to detonation of the first detonating time delay device is prevented by embedding the first detonating time delay device in a cap insensitive explosive.

35. The method according to claim 30 wherein the second detonating time delay device is initiated in response to the initiation of a detonating cord lead connecting the first and second time delay devices.

36. The method according to claim 30 wherein a primer is initiated in response to the detonation of the second detonating time delay device.

37. A downhole delay assembly for detonating explosive placed in a blasthole, the assembly comprising:

a substantially flat support;

a primer for initiating explosive in the blasthole connected to the support;

a first non-electric time delay blasting cap on the support for introducing a first time delay in a detonation sequence;

a detonating cord connected mechanically to the support and connected operationally to the first non-electric time delay blasting cap;

a section of tubing on the support for containing energy from detonation of the first non-electric time delay blasting cap for preventing detonation of explosive in the blasthole in response to detonation of the first non-electric time delay blasting cap;

a second non-electric time delay blasting cap on the support for introducing a second time delay in the detonation sequence and for initiating the primer; and a lead connecting the first non-electric time delay blasting cap to the second non-electric time delay blasting cap for initiating the second non-electric time delay blasting cap in response to the detonation of the first non-electric time delay blasting cap.

38. The downhole delay assembly as claimed in claim 37 additionally comprising a container of explosive wherein the substantially flat support is embedded in the container of explosive.

39. A downhole delay assembly for detonating explosive placed in a blasthole, the assembly comprising:

a substantially flat support;

a primer for initiating explosive in the blasthole connected to the support;

a first non-electric time delay blasting cap on the support for introducing a first time delay in a detonation sequence;

a detonating cord connected mechanically to the support and connected operationally to the first non-electric time delay blasting cap;

a second non-electric time delay blasting cap on the support for introducing a second time delay in the detonation sequence and for initiating the primer;

a lead connecting the first non-electric time delay blasting cap to the second non-electric time delay blasting cap for initiating the second non-electric time delay blasting cap in response to the detonation of the first non-electric time delay blasting cap;

a section of tubing in the support for protecting the lead connecting the first non-electric time delay blasting cap to the second non-electric time delay blasting cap; and a body of cap insensitive explosive having the first detonating time delay device embedded therein.

* * * * *